US009850837B2

(12) United States Patent
Ito et al.

(10) Patent No.: US 9,850,837 B2
(45) Date of Patent: Dec. 26, 2017

(54) MONITORING DEVICE FOR FUEL INJECTION AMOUNT CONTROL APPARATUS

(71) Applicant: TOYOTA JIDOSHA KABUSHIKI KAISHA, Toyota-shi, Aichi-ken (JP)

(72) Inventors: Yoshiyasu Ito, Toyota (JP); Morihisa Sakamoto, Toyota (JP); Takuya Inamasu, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 112 days.

(21) Appl. No.: 15/096,382

(22) Filed: Apr. 12, 2016

(65) Prior Publication Data

US 2016/0312736 A1 Oct. 27, 2016

(30) Foreign Application Priority Data

Apr. 22, 2015 (JP) ..... 2015-087665

(51) Int. Cl.
*F02D 41/00* (2006.01)
*F02D 41/06* (2006.01)
(Continued)

(52) U.S. Cl.
CPC ..... *F02D 41/061* (2013.01); *F02D 41/064* (2013.01); *F02D 41/221* (2013.01);
(Continued)

(58) Field of Classification Search
CPC ..... F02D 41/061; F02D 41/064; F02D 41/22; F02D 41/0681
See application file for complete search history.

(56) References Cited

U.S. PATENT DOCUMENTS 5,233,965 A * 8/1993 Ishikawa ..... F02D 41/061 123/491
8,498,800 B2 * 7/2013 Tsuyuguchi ..... B62K 11/14 123/344

(Continued)

FOREIGN PATENT DOCUMENTS

JP H11-173188 A 6/1999
JP 2013-238203 A 11/2013

*Primary Examiner* — Thomas Moulis
(74) *Attorney, Agent, or Firm* — Oliff PLC

(57) ABSTRACT

A microcomputer determines that an abnormality has occurred in calculation functions regarding calculation of an injection amount command value and the like, based on a deviation of the injection amount command value, in an increasing manner, from a monitoring injection amount. The microcomputer calculates, based on a cooling fluid temperature of an engine, a start-up injection amount such that the start-up injection amount becomes smaller when the cooling fluid temperature is high than when the cooling fluid temperature is low, and uses the start-up injection amount as the injection amount command value immediately after the completion of start-up of the engine. Besides, the microcomputer uses the smaller one of a start-up injection amount calculated this time and a monitoring start-up injection amount calculated last time, as a monitoring start-up injection amount that is used as the aforementioned monitoring injection amount immediately after the completion of start-up of the engine.

2 Claims, 5 Drawing Sheets

(51) Int. Cl.
*F02D 41/22* (2006.01)
*F02D 41/38* (2006.01)

(52) U.S. Cl.
CPC .... *F02D 41/3809* (2013.01); *F02D 2200/021* (2013.01); *F02D 2200/0616* (2013.01)

(56) References Cited

U.S. PATENT DOCUMENTS

| | | | | |
|---|---|---|---|---|
| 9,759,151 | B2 * | 9/2017 | Ito | F02D 41/22 |
| 2003/0212484 | A1 * | 11/2003 | Takebayashi | F01N 3/2013 701/114 |
| 2008/0281506 | A1 * | 11/2008 | Washio | F02N 11/0848 701/113 |
| 2015/0073682 | A1 * | 3/2015 | Ito | F02D 41/1402 701/104 |
| 2016/0115889 | A1 * | 4/2016 | Tsukagoshi | F02D 41/047 123/491 |
| 2016/0281626 | A1 * | 9/2016 | Ito | F02D 41/22 |

* cited by examiner

MONITORING DEVICE FOR FUEL INJECTION AMOUNT CONTROL APPARATUS

INCORPORATION BY REFERENCE

The disclosure of Japanese Patent Application No. 2015-087665 filed on April 22, 2015 including the specification, drawings and abstract is incorporated herein by reference in its entirety.

BACKGROUND OF THE INVENTION

1. Field of the Invention

The invention relates to a monitoring device for a fuel injection amount control apparatus.

2. Description of Related Art

A fuel injection amount control apparatus for an engine that is mounted in a vehicle or the like drives injectors of the engine based on an injection amount command value calculated by a calculation unit, thereby controlling the amount of fuel injection by the injectors. At the time of normal engine operation, for example, after the completion of warm-up of the engine, the calculation unit of the fuel injection amount control apparatus obtains a basic injection amount based on an operation state of the engine such as an accelerator operation amount and an engine rotational speed, and assigns the basic injection amount to the aforementioned injection amount command value to calculate the injection amount command value.

Besides, in Japanese Patent Application Publication No. 2013-238203 (JP 2013-238203 A), there is described a monitoring device that determines whether or not there is an abnormality in the aforementioned calculation unit in the fuel injection amount control apparatus. This monitoring device calculates a monitoring injection amount equivalent to the aforementioned basic injection amount, based on the operation state of the engine such as the accelerator operation amount and the engine rotational speed, in parallel with calculation of the injection amount command value by the aforementioned calculation unit. Then, when the injection amount command value calculated by the aforementioned calculation unit deviates, in an increasing manner, from the aforementioned monitoring injection amount, the monitoring device determines that an abnormality has occurred in a function of calculating the injection command value in the aforementioned calculation unit.

Incidentally, the aforementioned accelerator operation amount is detected through the use of an accelerator position sensor, and the aforementioned engine rotational speed is detected through the use of a crank angle sensor. Incidentally, this accelerator position sensor and this crank angle sensor have a function of detecting a sensor abnormality, and can output a detection signal that is guaranteed to be natural, with the aid of the function.

By the way, the calculation unit of the fuel injection amount control apparatus obtains a start-up injection amount for enhancing the startability of the engine based on a cooling fluid temperature of the engine that is detected by a fluid temperature sensor from the start of start-up of the engine to the completion of start-up, and assigns the start-up injection amount to the injection amount command value to calculate the injection amount command value. Furthermore, after the completion of start-up of the engine, the aforementioned calculation unit assigns the larger one of the aforementioned start-up injection amount that decreases as the cooling fluid temperature of the engine rises, and the aforementioned basic injection amount that is obtained based on the operation state of the engine, to the injection amount command value, thereby calculating the injection amount command value.

On the other hand, it is preferable that the monitoring device determine whether or not there is an abnormality in the aforementioned calculation unit, immediately after the completion of start-up of the engine. It should be noted, however, that when the device calculates the aforementioned monitoring injection amount, sensors that do not have the function of detecting the presence of an abnormality upon the occurrence thereof, such as the fluid temperature sensor and the like, namely, sensors incapable of detecting a detection signal that is guaranteed to be normal cannot be employed to calculate the aforementioned monitoring injection amount. For this reason, the aforementioned monitoring injection amount cannot be calculated as a value equivalent to the start-up injection amount, based on the cooling fluid temperature detected by the fluid temperature sensor. Accordingly, at this time as well, the monitoring injection amount must be calculated through the use of sensors capable of outputting a detection signal that is guaranteed to be normal, such as the accelerator position sensor, the crank angle sensor and the like. There is no choice but to calculate the monitoring injection amount equivalent to the aforementioned basic injection amount, through the use of such sensors.

Therefore, in the case where the start-up injection amount becomes larger than the basic injection amount as a result of lowness of the cooling fluid temperature of the engine immediately after the completion of start-up of the engine and the start-up injection amount is assigned to the injection amount command value, even when the calculation unit is normal, the injection amount command value (equivalent to the start-up injection amount) deviates, in an increasing manner, from the monitoring injection amount (equivalent to the basic injection amount). Then, it may be erroneously determined, based on this deviation between the injection amount command value and the monitoring injection amount, that an abnormality has occurred in the calculation unit.

FIG. 8 is a time chart showing changes in the start-up injection amount, the basic injection amount and the injection amount command value from the start of start-up of the engine to the completion of start-up. As is apparent from the drawing, after the completion of start-up of the engine, while the larger one of the basic injection amount and the start-up injection amount is adopted as the injection amount command value (indicated by a broken line), the monitoring injection amount is calculated as a value equivalent to the basic injection amount. Therefore, when the start-up injection amount is larger than the basic injection amount, for example, immediately after the completion of start-up of the engine or the like, the injection amount command value may greatly deviate, in an increasing manner, from the monitoring injection amount in spite of normal calculation of the injection amount command value (equivalent to the start-up injection amount), and it may be erroneously determined, based on the deviation, that an abnormality has occurred in the calculation unit for calculating the injection amount command value.

SUMMARY OF THE INVENTION

In view of the aforementioned problem, the invention provides a monitoring device for a fuel injection amount control apparatus that can suppress the occurrence of an erroneous determination that an abnormality has occurred in a calculation unit after the completion of start-up of an engine.

According to one aspect of the invention, there is provided a monitoring device for a fuel injection amount control apparatus that is configured to drive an injector provided in an engine based on an injection amount command value. The monitoring device is equipped with a calculation unit and a determination unit. The calculation unit is configured to, in calculating the injection amount command value at intervals of a specified time, (i) calculate a start-up injection amount based on a cooling fluid temperature of the engine such that the start-up injection amount becomes smaller when the cooling fluid temperature is high than when the cooling fluid temperature is low, (ii) use the start-up injection amount as the injection amount command value from start of start-up of the engine to the completion of start-up of the engine, and (iii) use the larger one of the aforementioned start-up injection amount and a basic injection amount that is calculated based on an operation state of the engine, as the injection amount command value, after the completion of start-up of the engine. Besides, the aforementioned determination unit is configured to, in calculating a monitoring injection amount at intervals of a specified time, (i) use the larger one of a monitoring start-up injection amount that is calculated based on the start-up injection amount and a monitoring basic injection amount that is calculated based on the operation state of the engine, as the monitoring injection amount, (ii) use a start-up injection amount calculated this time by the aforementioned calculation unit, as the monitoring start-up injection amount, from start of start-up of the engine to the completion of start-up of the engine, (iii) use the smaller one of the start-up injection amount calculated this time by the aforementioned calculation unit and a last monitoring start-up injection amount that is calculated by the aforementioned determination unit, as a current monitoring start-up injection amount, after the completion of start-up of the engine, and (iv) determine that the calculation unit is abnormal when an injection amount command value calculated this time by the calculation unit deviates, in an increasing manner, from a monitoring injection amount calculated this time.

According to the configuration of the monitoring device for the fuel injection amount control apparatus as described above, when the start-up injection amount becomes larger than the basic injection amount, for example, immediately after the completion of start-up of the engine or the like, the start-up injection amount is adopted as the injection amount command value, and the injection amount command value is thereby calculated by the aforementioned calculation unit. Then, when this injection amount command value deviates, in an increasing manner, from the aforementioned monitoring injection amount, it is determined by the aforementioned determination unit that the aforementioned calculation unit is abnormal.

The aforementioned determination unit calculates the aforementioned monitoring injection amount as follows. That is, the aforementioned determination unit uses the larger one of the monitoring start-up injection amount that is calculated based on the start-up injection amount calculated by the aforementioned calculation unit, and the monitoring basic injection amount that is calculated based on the operation state of the engine by the aforementioned determination unit separately from the basic injection amount that is calculated by the aforementioned calculation unit, as the monitoring injection amount. Then, under the condition that there is no abnormality in the aforementioned calculation unit, when the start-up injection amount becomes larger than the basic injection amount and is used as the injection amount command value, for example, immediately after the completion of start-up of the engine or the like, the monitoring start-up injection amount becomes larger than the monitoring basic injection amount and is used as the monitoring injection amount.

It should be noted herein that since the cooling fluid temperature of the engine after the completion of start-up gradually rises, the start-up injection amount that is calculated based on the cooling fluid temperature by the aforementioned calculation unit gradually decreases. Therefore, in the case where the start-up injection amount becomes larger than the basic injection amount and is used as the injection amount command value immediately after the completion of start-up of the engine, when there is no abnormality in the aforementioned calculation unit, the start-up injection amount calculated this time by the calculation unit does not become larger than the start-up injection amount calculated last time. Furthermore, at this time, the monitoring start-up injection amount calculated this time by the aforementioned determination unit does not become larger than the monitoring start-up injection amount calculated last time, either. This is because the smaller one of the start-up injection amount calculated this time by the aforementioned calculation unit and the monitoring start-up injection amount calculated last time by the aforementioned determination unit is used as the current monitoring start-up injection amount, after the completion of start-up of the engine.

In the case where the start-up injection amount becomes larger than the basic injection amount and is used as the injection amount command value immediately after the completion of start-up of the engine, when the start-up injection amount calculated this time by the aforementioned calculation unit is larger than the start-up injection amount calculated last time, the possibility of the occurrence of an abnormality in the aforementioned calculation unit is high. In this case, as a result of the abnormality in the aforementioned calculation unit, the start-up injection amount calculated this time by the aforementioned calculation unit becomes larger than the last monitoring start-up injection amount calculated by the aforementioned determination unit. Thus, the aforementioned last monitoring start-up injection amount is used as the current monitoring start-up injection amount. Furthermore, at this time, the monitoring start-up injection amount becomes larger than the monitoring basic injection amount and is used as the monitoring injection amount. Thus, the injection amount command value (the start-up injection amount calculated this time) deviates, in an increasing manner, from the monitoring injection amount (the last monitoring start-up injection amount). Then, it can be determined, based on the deviation, that an abnormality has occurred in the aforementioned calculation unit for calculating the injection amount command value.

On the other hand, in the case where the start-up injection amount becomes larger than the basic injection amount and is used as the injection amount command value immediately after the completion of start-up of the engine, when there is no abnormality in the aforementioned calculation unit, the start-up injection amount calculated this time becomes smaller than the start-up injection amount calculated last time. At this time, the start-up injection amount calculated this time by the aforementioned calculation unit becomes smaller than the last monitoring start-up injection amount calculated by the aforementioned determination unit. Therefore, the start-up injection amount calculated this time is used as the current monitoring start-up injection amount. Furthermore, at this time, the monitoring start-up injection amount becomes larger than the monitoring basic injection amount and is used as the monitoring injection amount. Thus, the injection amount command value calculated by the aforementioned calculation unit (the start-up injection amount calculated this time) does not deviate, in an increasing manner, from the monitoring injection amount (the current monitoring start-up injection amount). Therefore, the occurrence of an erroneous determination that an abnormality has occurred in the calculation unit for calculating the injection amount command value, based on a deviation of the injection amount command value, in an increasing manner, from the monitoring injection amount in spite of normalness of the calculation unit, can be suppressed.

Besides, the aforementioned monitoring device may be further equipped with a storage unit in which a change pattern of a maximum value that can be assumed by the start-up injection amount with the lapse of time after the completion of start-up of the engine is stored. In this case, conceivably, the aforementioned determination unit may be configured to specify the current monitoring start-up injection amount after the completion of start-up of the engine as follows. That is, the aforementioned determination unit may be configured to, after completion of start-up of the engine, use the smallest one of the start-up injection amount calculated this time by the aforementioned calculation unit, the last monitoring start-up injection amount calculated by the aforementioned determination unit, and the maximum value obtained based on an elapsed time from completion of start-up of the engine using the aforementioned change pattern that is stored in the aforementioned storage unit, as the current monitoring start-up injection amount.

As an abnormality in the aforementioned calculation unit, there is also an abnormality that the start-up injection amount that is calculated at intervals of the specified time remains fixed. In the case where this abnormality has occurred, when the start-up injection amount becomes larger than the basic injection amount and is used as the injection amount command value immediately after the completion of start-up of the engine, the aforementioned maximum value eventually becomes smaller than the start-up injection amount calculated this time by the aforementioned calculation unit and the last monitoring start-up injection amount calculated by the aforementioned determination unit. Then, when the aforementioned maximum value becomes smaller than the start-up injection amount calculated this time by the aforementioned calculation unit and the last monitoring start-up injection amount calculated by the aforementioned determination unit, the maximum value is used as the current monitoring start-up injection amount. At this time, the monitoring start-up injection amount becomes larger than the monitoring basic injection amount and is used as the monitoring injection amount. Thus, the injection amount command value calculated by the aforementioned calculation unit (the start-up injection amount calculated this time) deviates, in an increasing manner, from the monitoring injection amount (the aforementioned maximum value as the current monitoring start-up injection amount). Then, it can be determined, based on the deviation, that an abnormality has occurred in the calculation unit for calculating the injection amount command value.

BRIEF DESCRIPTION OF THE DRAWINGS

Features, advantages, and technical and industrial significance of an exemplary embodiment of the invention will be described below with reference to the accompanying drawings, in which like numerals denote like elements, and wherein.

DETAILED DESCRIPTION OF EMBODIMENT

Figure 1:
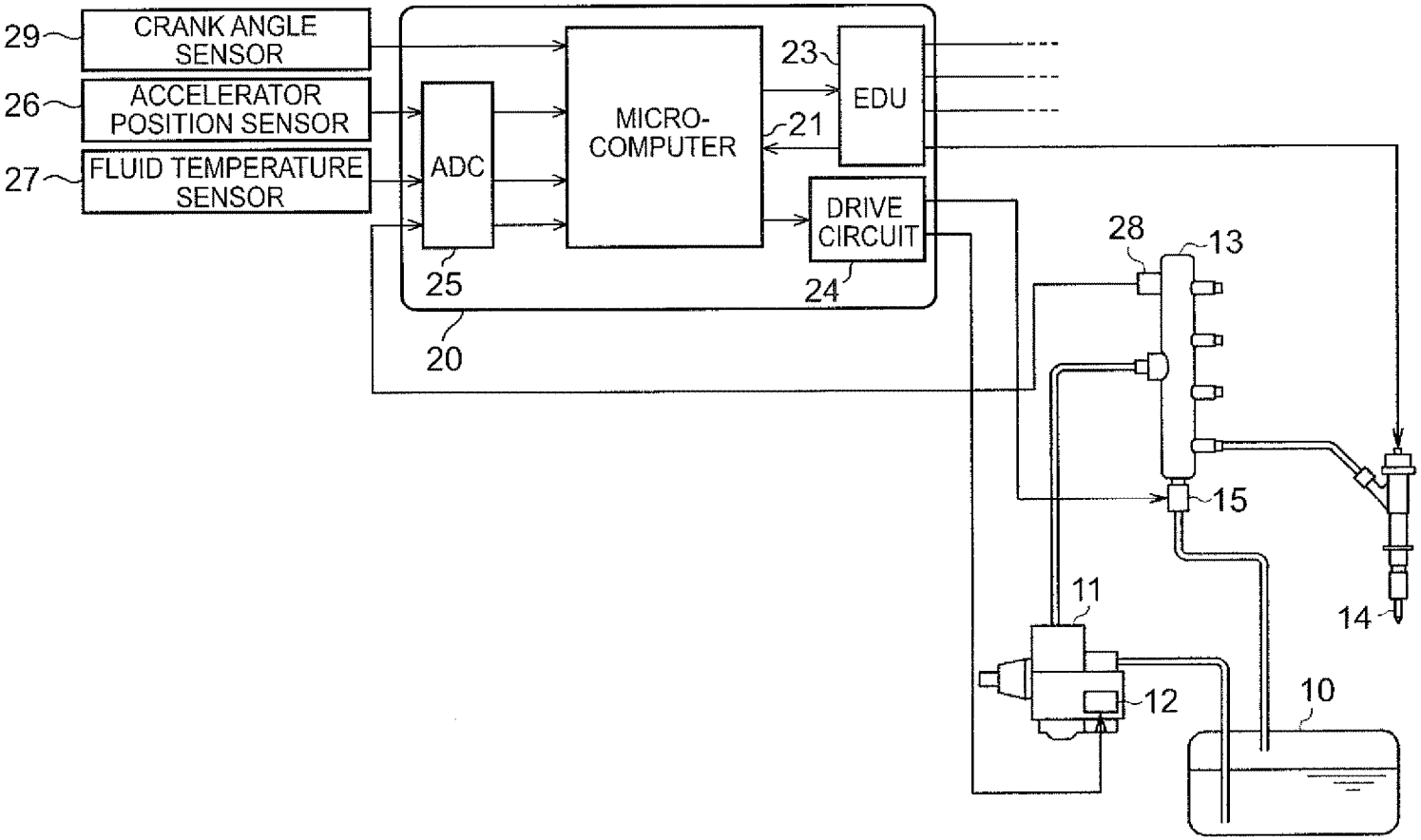
FIG. 1 is a diagram schematically showing the configurations of a monitoring device for a fuel injection amount control apparatus and a fuel supply system of an engine to which the device is applied, in the embodiment as an example of the monitoring device for the fuel injection amount control apparatus according to the invention.

One embodiment of a monitoring device for a fuel injection amount control apparatus will be described hereinafter with reference to FIGS. 1 to 7. FIG. 1 shows a fuel supply system of a diesel engine to which the fuel injection amount control apparatus according to this embodiment of the invention is applied. The fuel supply system of the engine is provided with a fuel pump 11 that pressurizes and discharges the fuel pumped up from a fuel tank 10. A pressure regulating valve 12 for regulating the pressure of discharged fuel is installed in the fuel pump 11. The fuel discharged by the fuel pump 11 is force-fed to a common rail 13 and stored therein. Then, the fuel stored in the common rail 13 is distributed and supplied to injectors 14 of respective cylinders. Incidentally, a pressure reducing valve 15 that lowers the pressure of the fuel in the common rail 13 (a rail pressure) by returning the fuel in the common rail 13 to the fuel tank 10 is disposed in the common rail 13.

The engine that is equipped with this fuel supply system is controlled by an electronic control unit 20. The electronic control unit 20 is equipped with a microcomputer 21 that executes various computation processes regarding engine control. Besides, the electronic control unit 20 is equipped with an electronic drive unit (an EDU) 23 that drives the injectors 14 of the respective cylinders in accordance with a command from the microcomputer 21. Besides, the electronic control unit 20 is also provided with a drive circuit 24 that drives the pressure regulating valve 12 and the pressure reducing valve 15 in accordance with a command from the microcomputer 21.

Detection signals of an accelerator position sensor 26 that detects an accelerator operation amount Accp, a fluid temperature sensor 27 that detects an engine fluid temperature Thw as a temperature of cooling fluid of the engine, a rail pressure sensor 28 that detects a rail pressure Per, a crank angle sensor 29 that outputs a pulse-like crank angle signal in accordance with rotation of an output shaft of the engine, and the like are input to the electronic control unit 20. Incidentally, the detection signals of the accelerator position sensor 26, the fluid temperature sensor 27 and the rail pressure sensor 28 are input to the microcomputer 21 after being converted into digital signals by an AD converter (an ADC) 25 that is disposed in the electronic control unit 20. Besides, the crank angle signal output by the crank angle sensor 29 is directly input to the microcomputer 21.

Next, fuel injection amount control that is performed as a part of engine control by the electronic control unit 20 will be described in detail. This fuel injection amount control is realized by driving the injectors 14 based on an injection amount command value Qfin calculated by the microcomputer 21. Incidentally, in the case where an abnormality has occurred in various calculation functions of the microcomputer 21, when the amount of fuel injection is controlled using the injection amount command value Qfin calculated through the functions, the amount of fuel injection assumes an inappropriate value and adversely influences the operation of the engine. In order to cope with this phenomenon, the microcomputer 21 also has a function as a determination unit that determines whether or not an abnormality has occurred in the aforementioned calculation functions regarding calculation of the injection amount command value Qfin and the like, and deals with the abnormality in the aforementioned calculation functions through the use of the function as the determination unit.

Figure 2:
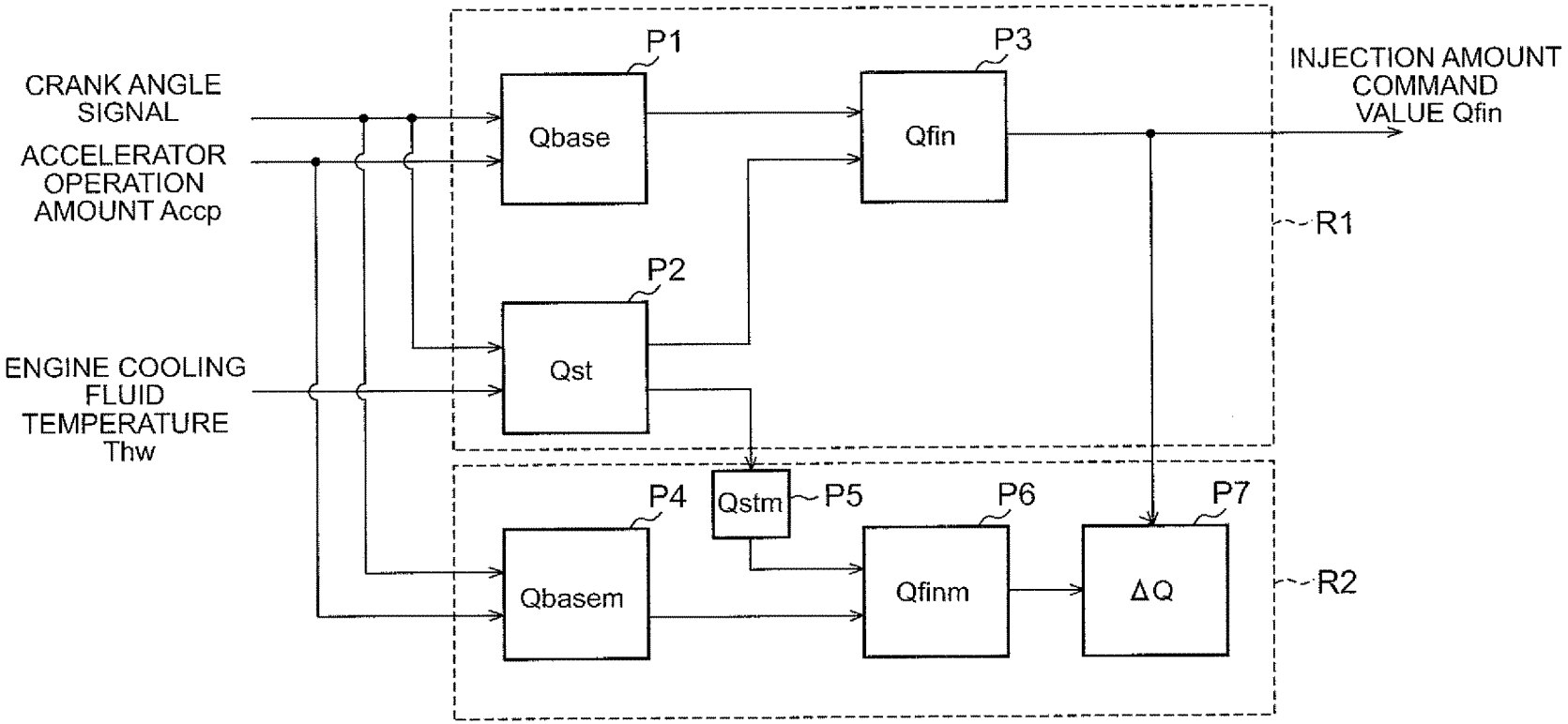
FIG. 2 is a block diagram showing the flow of a process of calculating an injection amount command value and a process of monitoring the calculation, in the embodiment of the invention.

FIG. 2 shows the outline of a calculation routine R1 that is executed through the microcomputer 21 to calculate the injection amount command value Qfin, and the outline of a monitoring routine R2 for monitoring whether or not the injection amount command value Qfin is normally calculated. The calculation routine R1 and the monitoring routine R2 are periodically executed at intervals of a specified time. As is apparent from the drawing, the aforementioned calculation routine R1 is constituted of three processes, namely, a basic injection amount computation process P1, a start-up injection amount computation process P2, and an injection amount command value computation process P3. Besides, the aforementioned monitoring routine R2 is constituted of four processes, namely, a monitoring basic injection amount computation process P4, a motoring start-up injection amount computation process P5, a monitoring injection amount computation process P6, and an abnormality determination process P7.

In the basic injection amount computation process P1 of the calculation routine R1, a basic injection amount Qbase is calculated with reference to a map stored in the microcomputer 21, based on an operation state of the engine such as the accelerator operation amount Accp, an engine rotational speed Ne that is obtained based on the crank angle signal, and the like. Incidentally, the basic injection amount Qbase calculated herein may be subjected to various corrections.

In the start-up injection amount computation process P2, a start-up injection amount Qst is calculated with reference to the map stored in the microcomputer 21, based on the engine rotational speed Ne and the engine fluid temperature Thw. The start-up injection amount Qst thus calculated is smaller when the engine fluid temperature Thw is high than when the engine fluid temperature Thw is low, with the intention of enhancing the startability of the engine etc. Specifically, the start-up injection amount Qst linearly decreases as the engine fluid temperature Thw rises. Incidentally, the start-up injection amount Qst at this time is not absolutely required to linearly decrease as the engine fluid temperature Thw rises. The start-up injection amount Qst may decrease stepwise as the engine fluid temperature Thw rises.

In the injection amount command value computation process P3, the start-up injection amount Qst is assigned to the injection amount command value Qfin from the start of start-up of the engine to the completion of start-up. The larger one of the start-up injection amount Qst and the basic injection amount Qbase is assigned to the injection amount command value Qfin after the completion of start-up of the engine. The injection amount command value Qfin is calculated through this assignment. Incidentally, when executing the aforementioned injection amount command value computation process P3, the microcomputer 21 plays the role of the calculation unit that calculates the injection amount command value Qfin.

In the monitoring basic injection amount computation process P4 of the monitoring routine R2, a monitoring basic injection amount Qbasem is calculated with reference to the map stored in the microcomputer 21, based on the operation state of the engine such as the accelerator operation amount Accp, the engine rotational speed Ne that is obtained based on the crank angle signal, and the like. Incidentally, in a manner corresponding to the various corrections to which the basic injection amount Qbase is subjected in the basic injection amount computation process P1 of the calculation routine R1, the monitoring basic injection amount Qbasem calculated herein is subjected to various similar corrections. The calculation of the monitoring basic injection amount Qbasem in the monitoring basic injection amount computation process P4 is carried out in parallel with and separately from the calculation of the basic injection amount Qbase in the calculation routine R1.

In the monitoring start-up injection amount computation process P5, the start-up injection amount Qst that is calculated at intervals of a specified time in the calculation routine R1 is fetched every time the calculation thereof is carried out. Furthermore, a monitoring start-up injection amount Qstm is calculated at intervals of a specified time, based on the start-up injection amount Qst thus fetched and the like.

In the monitoring injection amount computation process P6, the larger one of the monitoring basic injection amount Qbasem and the monitoring start-up injection amount Qstm is assigned to the monitoring injection amount Qfinm. The monitoring injection amount Qfinm is calculated through this assignment.

In the abnormality determination process P7, the aforementioned monitoring injection amount Qfinm is compared with the aforementioned injection amount command value Qfin calculated in the calculation routine R1 to determine whether or not an abnormality has occurred in the calculation functions of the microcomputer 21. Specifically, an amount $\Delta Q$ of deviation of the injection amount command value Qfin, in an increasing manner, from the monitoring injection amount Qfim is obtained. When the amount $\Delta Q$ of deviation is larger than a determination threshold H specified in advance through an experiment or the like, it is determined that an abnormality has occurred in the calculation functions of the microcomputer 21.

Incidentally, when it is determined that there is an abnormality in the aforementioned calculation functions, the microcomputer 21 executes a failsafe process for controlling the amount of fuel injection and the like such that the engine can be kept in operation to the maximum possible extent even in the case of an abnormality in the calculation functions.

Next, a method of calculating the monitoring start-up injection amount Qsm in the monitoring start-up injection amount computation process P5 will be described in detail. In the monitoring start-up injection amount computation process P5, the start-up injection amount Qst calculated this time by the calculation routine R1 is assigned to the monitoring start-up injection amount Qstm from the start of start-up of the engine to the completion of start-up. Incidentally, a change pattern of a maximum value Qstmax that can be assumed by the start-up injection amount Qst after the completion of start-up of the engine with the lapse of time is stored in the microcomputer 21. The microcomputer 21 in which this change pattern of the maximum value Qstmax is stored plays the role of a storage unit for storing the change pattern of the maximum value Qstmax.

Figure 3:
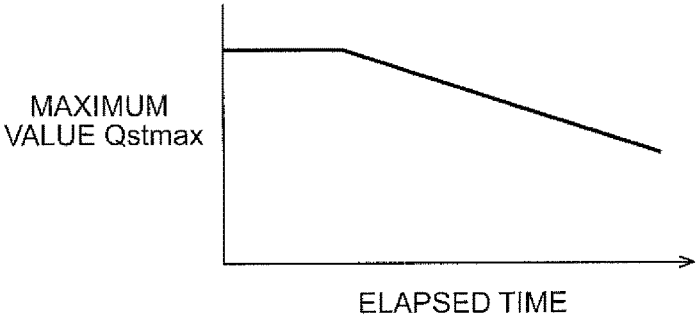
FIG. 3 is a graph showing changes in a maximum value of a start-up injection amount with the lapse of time after the completion of start-up of the engine.

FIG. 3 shows changes in the aforementioned maximum value Qstmax with the lapse of time after the completion of start-up of the engine. Then, in the monitoring start-up injection amount computation process P5 (FIG. 2) after the completion of start-up of the engine, the aforementioned maximum value Qstmax is obtained based on an elapsed time after the completion of start-up of the engine, using the aforementioned stored change pattern. Furthermore, in the monitoring start-up injection amount computation process P5 after the completion of start-up of the engine, the smallest one of the start-up injection amount Qst calculated this time, the last monitoring start-up injection amount Qstm and the aforementioned maximum value Qstmax is used as the current monitoring start-up injection amount Qstm. Thus, the current monitoring start-up injection amount Qstm is calculated.

Figure 4:
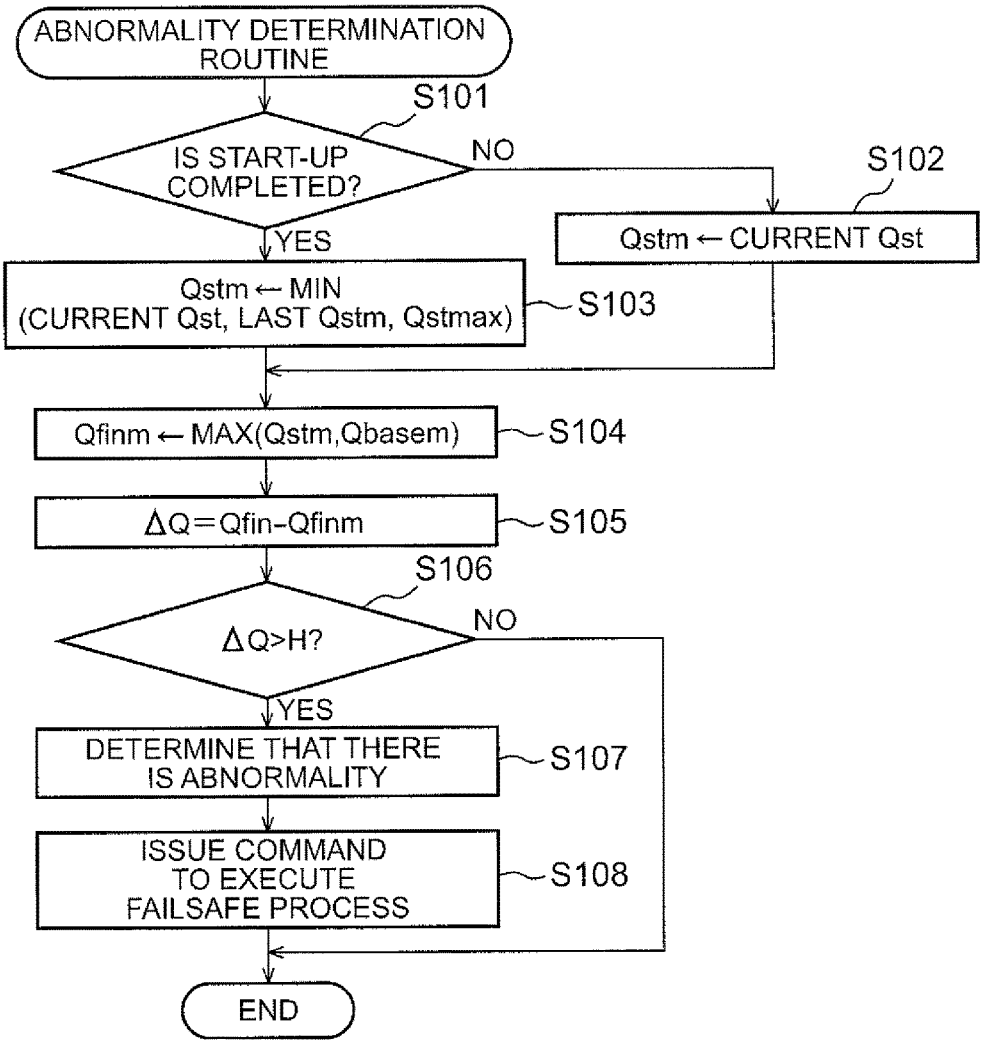
FIG. 4 is a flowchart showing a procedure of determining whether or not an abnormality has occurred in a calculation function of a microcomputer after the completion of start-up of the engine.

Next, the monitoring of the calculation functions of the microcomputer 21 after the completion of start-up of the engine according to the monitoring routine R2 will be described in detail. FIG. 4 is a flowchart showing an abnormality determination routine for determining whether or not an abnormality has occurred in the calculation functions of the microcomputer 21 regarding calculation of the injection amount command value Qfin and the like after the completion of start-up of the engine. This abnormality determination routine is periodically executed, for example, by interrupt at intervals of a predetermined time, through the microcomputer 21.

As the processing of step 101 (S101) of the abnormality determination routine, the microcomputer 21 determines whether or not start-up of the engine is completed. Incidentally, the engine is started up through the cranking of the engine by a starter. Therefore, it can be determined that start-up of the engine is completed, based on a state where the aforementioned starter is off during rotation of the engine and the transmission of motive power between the engine and a transmission is shut off.

If it is determined in the processing of S101 that start-up of the engine is not completed, namely, if the engine is in a phase from the start of start-up to the completion of start-up, the microcomputer 21 makes a transition to S102. As the processing of S102, the microcomputer 21 acquires the start-up injection amount Qst calculated this time through the start-up injection amount computation process P2 of FIG. 2, and assigns the start-up injection amount Qst to the monitoring start-up injection amount Qstm. The current monitoring start-up injection amount Qstm before the completion of start-up of the engine is calculated through this assignment. After that, the microcomputer 21 makes a transition to S104 of FIG. 4.

On the other hand, if it is determined in the processing of S101 that start-up of the engine is completed, the microcomputer 21 makes a transition to S103. As the processing of S103, the microcomputer 21 calculates the monitoring start-up injection amount Qstm after the completion of start-up of the engine. Specifically, the microcomputer 21 obtains the maximum value Qstmax of the start-up injection amount Qst that can be assumed at the moment, based on an elapsed time from the completion of start-up of the engine. Furthermore, the microcomputer 21 assigns the smallest one of the aforementioned maximum value Qstmax, the start-up injection amount Qst calculated this time through the start-up injection amount computation process P2 (FIG. 2), and the monitoring start-up injection amount Qst calculated through the last processing of S102 or S103 to the monitoring start-up injection amount Qstm. The current monitoring start-up injection amount Qstm after the completion of start-up of the engine is calculated through this assignment. After that, the microcomputer 21 makes a transition to S104.

Incidentally, the aforementioned processing of S102 and the aforementioned processing of S103 are equivalent to the monitoring start-up injection amount computation process P5 of FIG. 2. As the processing of S104 (FIG. 4), the microcomputer 21 assigns the larger one of the monitoring start-up injection amount Qstm and the monitoring basic injection amount Qbasem to the monitoring injection amount Qfinm. The calculation of the monitoring injection amount Qfinm is carried out through this assignment. This processing of S105 is equivalent to the monitoring injection amount computation process P6 of FIG. 2. Incidentally, when the start-up injection amount Qst is used as the injection amount command value Qfin based on a state where the start-up injection amount Qst is larger than the basic injection amount Qbase after the completion of start-up of the engine, the relationship in magnitude between the monitoring start-up injection amount Qstm that is calculated for monitoring and the monitoring basic injection amount Qbasem is also the same as the relationship in magnitude between the aforementioned start-up injection amount Qst and the aforementioned basic injection amount Qbase. Accordingly, when the start-up injection amount Qst is used as the injection amount command value Qfin as described above, the monitoring start-up injection amount Qstm becomes larger than the monitoring basic injection amount Qbasem, and this monitoring start-up injection amount Qstm is used as the monitoring injection amount Qfinm.

The processing of S105 of FIG. 4, the processing of S106 of FIG. 4 and the processing of S107 of FIG. 4 in the abnormality determination routine are equivalent to the abnormality determination process P7 of FIG. 2. As the processing of S105 (FIG. 4), the microcomputer 21 calculates the amount $\Delta Q$ of deviation between the injection amount command value Qfin and the monitoring injection amount Qfinm. This amount $\Delta Q$ of deviation is calculated by subtracting the monitoring injection amount Qfinm from the injection amount command value Qfin. After that, the microcomputer 21 makes a transition to S106. As the processing of S106, the microcomputer 21 determines whether or not the amount $\Delta Q$ of deviation is larger than the determination threshold H, and temporarily ends the abnormality determination routine if the result of the determination herein is negative. On the other hand, if the result of the determination in S106 is affirmative on the ground that the amount ΔQ of deviation is larger than the determination threshold H, the microcomputer 21 makes a transition to S107, and determines that an abnormality has occurred in the calculation functions. In this case, the microcomputer 21 makes a transition to S108.

As the processing of S108, the microcomputer 21 issues a command to execute the aforementioned failsafe process on the condition that start-up of the engine is completed. After that, the microcomputer 21 temporarily ends the abnormality determination routine. In the aforementioned failsafe process, the control of the amount of fuel injection and the like is performed such that the engine can be kept in operation to the maximum possible extent, even at the time of an abnormality in the aforementioned calculation functions. It should be noted, however, that when the engine cannot be kept in operation even if the amount of fuel injection and the like are thus controlled, the engine that is kept in operation is forcibly stopped (the engine is stalled) through the failsafe process.

Figure 5:
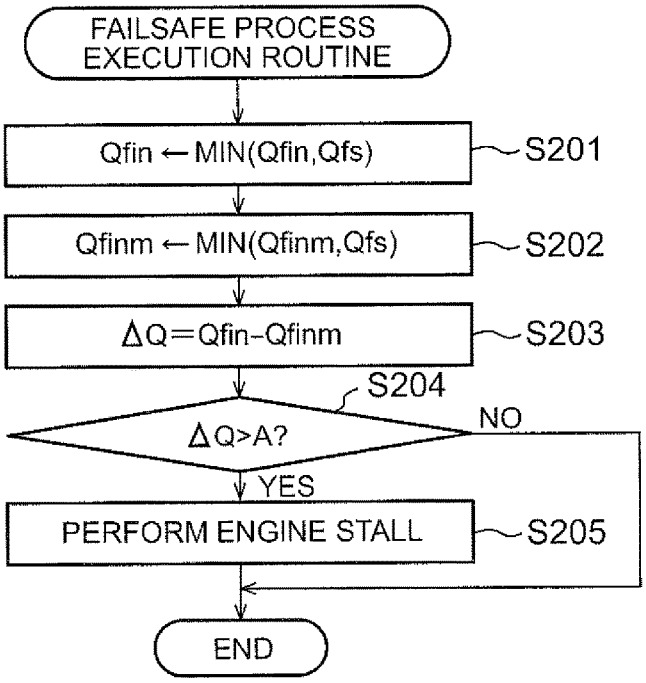
FIG. 5 is a flowchart showing a procedure of executing a failsafe process for the engine.

FIG. 5 is a flowchart showing a failsafe process execution routine for executing the aforementioned failsafe process. The routine is started when a command to execute the failsafe process is issued through the microcomputer 21. After being started, the routine is periodically executed by interrupt at intervals of a predetermined time.

As the processing of S201 of the failsafe process execution routine, the microcomputer 21 uses the smaller one of the injection amount command value Qfin calculated in the injection amount command value computation process P3 of FIG. 2 and an abnormality injection amount Qfs set to execute the failsafe process, as the new injection amount command value Qfin for fuel injection amount control. Incidentally, as the aforementioned abnormality injection amount Qfs, it is conceivable to adopt a fixed value that is optimally specified in advance through an experiment or the like as a fuel injection amount that allows the vehicle mounted with the engine to run in a retreating manner and that is smaller than at the time of normal engine operation.

As the processing of S202 (FIG. 5), the microcomputer 21 uses the smaller one of the monitoring injection amount Qfinm and the abnormality injection amount Qfs as the new monitoring injection amount Qfinm. As the processing of S203, the microcomputer 21 obtains the amount ΔQ of deviation between the newly set monitoring injection amount Qfinm and the injection amount command value Qfin (the abnormality injection amount Qfs). In the failsafe process, a relatively small value is used as the abnormality injection amount Qfs. Therefore, the abnormality injection amount Qfs is usually used as the monitoring injection amount Qfinm, and the amount ΔQ of deviation between the injection amount command value Qfin (the abnormality injection amount Qfs) and the monitoring injection amount Qfinm does not increase.

However, when an abnormality has occurred in the calculation functions of the microcomputer 21, the deviation between the injection amount command value Qfin and the monitoring injection amount Qfinm may increase as a result of the aforementioned abnormality even under the aforementioned circumstance. In this case, it is difficult to keep the engine in operation even when the failsafe process is executed. Therefore, as the processing of S204, the microcomputer 21 determines whether or not the amount ΔQ of deviation is larger than a predetermined value A (e.g., a value smaller than the determination threshold H is adopted). If the result of the determination herein is affirmative, the microcomputer 21 forcibly stops the engine (stalls the engine) as the processing of S205.

Incidentally, if the result of the determination in S204 is negative, the microcomputer 21 temporarily ends the failsafe process execution routine, and stops periodical execution of the failsafe process execution routine after executing the processing of S205.

Figure 6:
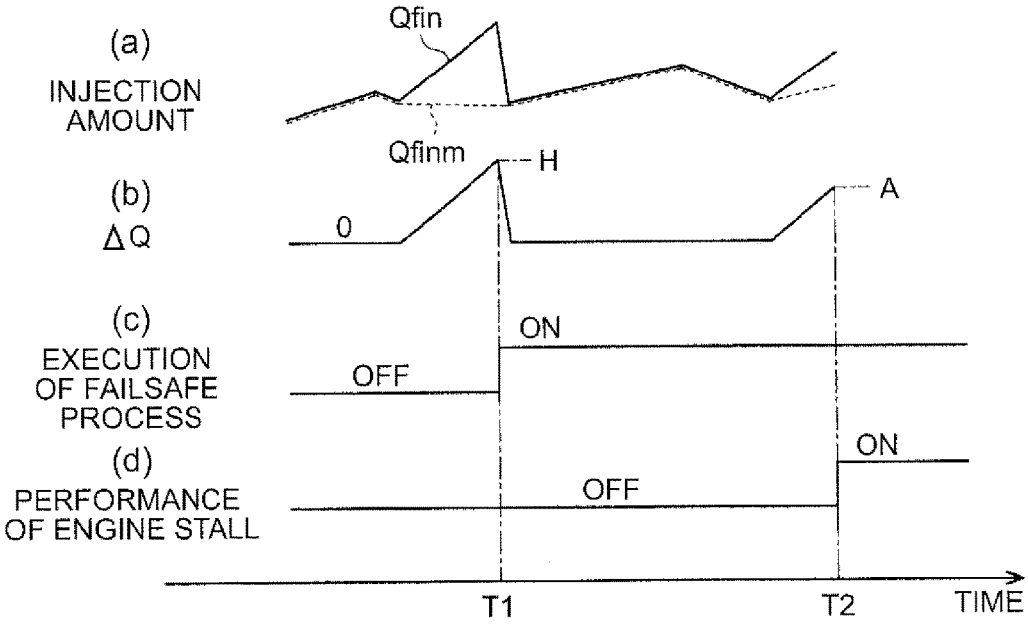
FIG. 6 is constituted of time charts (a) to (d) showing changes in a fuel injection amount of the engine, changes in a deviation amount (which will be described later), a mode of executing the failsafe process, and a mode of performing forcible stop of the engine (engine stall) respectively.

FIG. 6 is constituted of time charts showing a mode of executing the failsafe process and a mode of performing forcible stop of the engine (engine stall). When the injection amount command value Qfin (indicated by a solid line) greatly deviates from the monitoring injection amount Qfinm (indicated by a broken line) as shown in FIG. 6 (*a*) due to an abnormality in the calculation functions of the microcomputer 21, the amount ΔQ of deviation becomes larger than the determination threshold H as shown in FIG. 6 (*b*) (at a timing T1). The failsafe process is executed as shown in FIG. 6 (*c*), based on a state where the amount ΔQ of deviation thus becomes larger than the determination threshold H. Furthermore, when the injection amount command value Qfin (indicated by the solid line) deviates from the monitoring injection amount Qfinm (indicated by the broken line) as shown in FIG. 6 (*a*) even under the state where the failsafe process has been executed, the engine is forcibly stopped (the engine is stalled) as shown in FIG. 6 (*d*) based on a state where the amount ΔQ of deviation becomes larger than the predetermined value A as shown in FIG. 6 (*b*) (at a timing T2).

Next, the operation of the monitoring device for the fuel injection amount control apparatus will be described. When the engine fluid temperature Thw is low, for example, immediately after the completion of start-up of the engine or the like, the start-up injection amount Qst that is obtained based on the engine fluid temperature Thw becomes larger than the basic injection amount Qbase that is obtained based on the operation state of the engine. At this time, the start-up injection amount Qst is adopted as the injection amount command value Qfin, and the injection amount command value Qfin is thereby calculated. Then, when this injection amount command value Qfin deviates, in an increasing manner, from the aforementioned monitoring injection amount Qfinm, it is determined that an abnormality has occurred in the calculation functions of the microcomputer 21.

The aforementioned monitoring injection amount Qfinm for determining whether or not there is an abnormality in the calculation functions of the microcomputer 21 is calculated as follows. That is, the larger one of the monitoring start-up injection amount Qstm that is calculated based on the aforementioned start-up injection amount Qst and the like and the monitoring basic injection amount Qbasem that is calculated based on the operation state of the engine in the monitoring routine R2 separately from the aforementioned basic injection amount Qbase is used as the monitoring injection amount Qfinm. Then, under the condition that there is no abnormality in the calculation functions of the microcomputer 21, when the start-up injection amount Qst becomes larger than the basic injection amount Qbase and is used as the injection amount command value Qfin, for example, immediately after the completion of start-up of the engine or the like, the monitoring start-up injection amount Qstm becomes larger than the monitoring basic injection amount Qbasem and is used as the monitoring injection amount Qfinm.

It should be noted herein that since the fluid temperature Thw of the engine after the completion of start-up gradually rises, the aforementioned start-up injection amount Qst that is calculated based on the engine fluid temperature Thw gradually decreases. Therefore, in the case where the start-up injection amount Qst becomes larger than the basic injection amount Qbase and is used as the injection amount command value Qfin immediately after the completion of start-up of the engine, when there is no abnormality in the calculation functions of the microcomputer 21, the start-up injection amount Qst calculated this time does not become larger than the start-up injection amount Qst calculated last time. Furthermore, at this time, the monitoring start-up injection amount Qstm calculated this time in the monitoring routine R2 does not become larger than the monitoring start-up injection amount Qstm calculated last time, either. This is because the smallest one of the start-up injection amount Qst calculated this time, the monitoring start-up injection amount Qstm calculated last time, and the maximum value Qstmax is used as the current monitoring start-up injection amount Qstm after the completion of start-up of the engine.

Accordingly, in the case where the start-up injection amount Qst becomes larger than the basic injection amount Qbase and is used as the injection amount command value Qfin immediately after the completion of start-up of the engine, when the start-up injection amount Qst calculated this time is larger than the start-up injection amount Qst calculated last time, the possibility of the occurrence of an abnormality in the calculation functions of the microcomputer 21 is high. In this case, as a result of an abnormality in the aforementioned calculation functions, the start-up injection amount Qst calculated this time becomes larger than the last monitoring start-up injection amount Qstm, and the aforementioned last monitoring start-up injection amount Qstm is used as the current monitoring start-up injection amount Qstm. Furthermore, at this time, the monitoring start-up injection amount Qstm becomes larger than the monitoring basic injection amount Qbasem and is used as the monitoring injection amount Qfinm. Thus, the injection amount command value Qfin (the start-up injection amount Qst calculated this time) deviates, in an increasing manner, from the monitoring injection amount Qfinm (the last monitoring start-up injection amount Qstm). Then, it can be determined, based on the deviation, that an abnormality has occurred in the calculation functions of the microcomputer 21 for calculating the injection amount command value Qfin.

Incidentally, the aforementioned abnormality in the calculation functions of the microcomputer 21 (hereinafter referred to as an abnormality E1), namely, an abnormality that the start-up injection amount Qst calculated this time becomes larger than the start-up injection amount Qst calculated last time results from, for example, abnormalization of stored data.

On the other hand, in the case where the start-up injection amount Qst becomes larger than the basic injection amount Qbase and is used as the injection amount command value Qfin immediately after the completion of start-up of the engine, when there is no abnormality in the calculation functions of the microcomputer 21, the start-up injection amount Qst calculated this time becomes smaller than the start-up injection amount Qst calculated last time. At this time, the start-up injection amount Qst calculated this time becomes smaller than the last monitoring start-up injection amount Qstm, and the start-up injection amount Qst calculated this time is used as the current monitoring start-up injection amount Qstm. Furthermore, at this time, the monitoring start-up injection amount Qstm becomes larger than the monitoring basic injection amount Qbasem and is used as the monitoring injection amount Qfinm. Thus, the injection amount command value Qfin (the start-up injection amount Qst calculated this time) does not deviate, in an increasing manner, from the monitoring injection amount Qfinm (the current monitoring start-up injection amount Qstm). Therefore, the occurrence of an erroneous determination that an abnormality has occurred in the calculation functions of the microcomputer 21, based on a deviation of the injection amount command value Qfin, in an increasing manner, from the monitoring injection amount Qfinm in spite of normalness of the aforementioned calculation functions, can be suppressed.

Incidentally, as an abnormality in the calculation functions of the microcomputer 21, an abnormality that the start-up injection amount Qst that is calculated at intervals of a specified time remains fixed (hereinafter referred to as an abnormality E2) also arises in addition to the aforementioned abnormality E1.

In the case where this abnormality E2 has occurred, when the start-up injection amount Qst becomes larger than the basic injection amount Qbase and is used as the injection amount command value Qfin immediately after the completion of start-up of the engine, the aforementioned maximum value Qstmax eventually becomes smaller than the start-up injection amount Qst calculated this time and the monitoring start-up injection amount Qstm calculated last time. Then, when the aforementioned maximum value Qstmax becomes smaller than the start-up injection amount Qst calculated this time and the monitoring start-up injection amount Qstm calculated last time, the maximum value Qstmax is used as the current monitoring start-up injection amount Qstm. At this time, the monitoring start-up injection amount Qstm becomes larger than the monitoring basic injection amount Qbasem and is used as the monitoring injection amount Qfinm. Thus, the injection amount command value Qfin (the start-up injection amount Qst calculated this time) deviates, in an increasing manner, from the monitoring injection amount Qfinm (the aforementioned maximum value Qstmax as the current monitoring start-up injection amount Qstm). Then, it can be determined, based on the deviation, that the aforementioned abnormality E2 has occurred in the calculation functions of the microcomputer 21.

Figure 7:
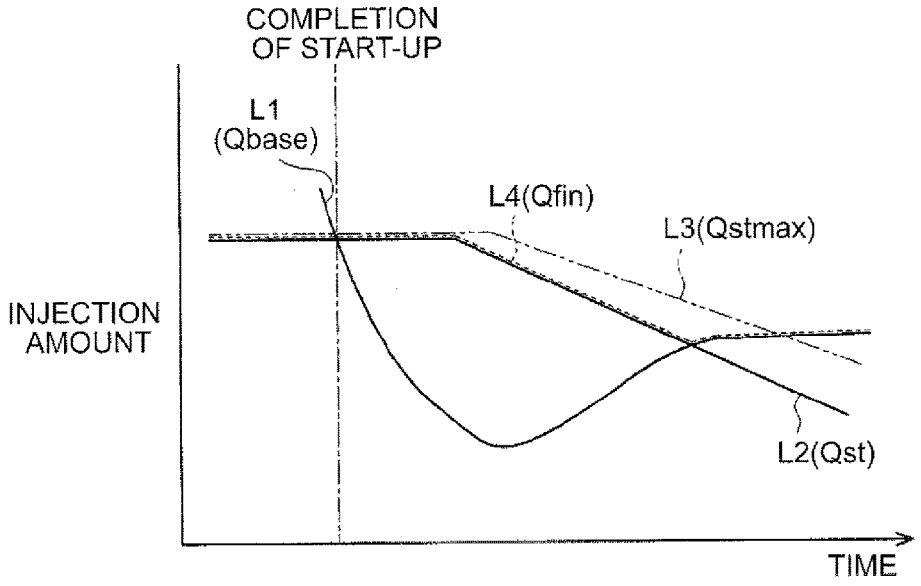
FIG. 7 is a time chart showing changes in the start-up injection amount, a basic injection amount, the injection amount command value and the maximum value of the start-up injection amount after the start of start-up of the engine and after the completion of start-up.
Figure 8:
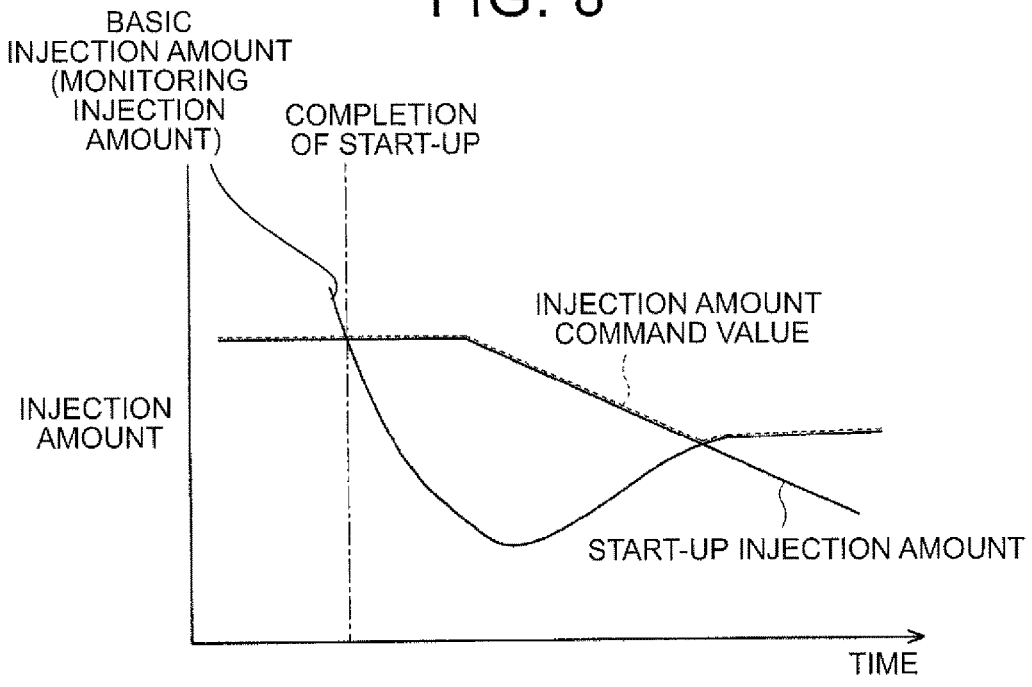
FIG. 8 is a time chart showing changes in the start-up injection amount, the basic injection amount and the injection amount command value after the start of start-up of the engine and after the completion of start-up.

FIG. 7 is a time chart showing changes in the start-up injection amount Qst, the basic injection amount Qbase, the injection amount command value Qfin and the maximum value Qstmax after the start of start-up of the engine and after the completion of start-up. After the completion of start-up of the engine, the larger one of the basic injection amount Qbase indicated by a solid line L1 and the start-up injection amount Qst indicated by a solid line L2 is adopted as the injection amount command value Qfin (indicated by a broken line L4). Therefore, in the case where the start-up injection amount Qst becomes larger than the basic injection amount Qbase as a result of lowness of the engine fluid temperature Thw, for example, immediately after the completion of start-up of the engine or the like, and the start-up injection amount Qst is adopted as the injection amount command value Qfin, if the monitoring injection amount Qfinm is calculated as a value equivalent to the basic injection amount Qbase, the following problem arises. That is, even when the calculation functions of the microcomputer 21 are normal, the injection amount command value Qfin (equivalent to the start-up injection amount Qst) deviates, in an increasing manner, from the monitoring injection amount Qfinm (equivalent to the basic injection amount Qbase). It is erroneously determined, based on the deviation, that an abnormality has occurred in the aforementioned calculation functions.

However, the start-up injection amount Qst is used as the injection amount command value Qfin after the completion of start-up of the engine, the smallest one of the start-up injection amount Qst calculated this time, the monitoring start-up injection amount Qstm calculated last time, and the maximum value Qstmax (indicated by an alternate long and two short dashes line L3 in the drawing) is used as the current monitoring start-up injection amount Qstm. Furthermore, the monitoring start-up injection amount Qstm is used as the monitoring injection amount Qfinm. Incidentally, in the example of FIG. 7, in the case where the start-up injection amount Qst calculated this time is used as the current monitoring start-up injection amount Qstm as described above when the calculation functions of the microcomputer 21 are normal and the start-up injection amount Qst is used as the injection amount command value Qfin, the monitoring injection amount Qfinm changes on the solid line L2. Accordingly, there is no possibility of the injection amount command value Qfin deviating from the monitoring injection amount Qfinm despite normalness of the calculation functions of the microcomputer 21. Therefore, the occurrence of an erroneous determination, based on the deviation, that an abnormality has occurred in the calculation functions of the microcomputer 21 regarding calculation of the injection amount command value Qfin and the like is suppressed.

According to the present embodiment of the invention described hereinbefore in detail, the following effects are obtained. (1) The occurrence of an erroneous determination that an abnormality has occurred in the calculation functions of the microcomputer 21 regarding calculation of the injection amount command value Qfin and the like can be suppressed.

(2) Even when one of the aforementioned abnormalities E1 and E2 has occurred as an abnormality in the calculation functions of the microcomputer 21 regarding calculation of the injection amount command value Qfin and the like, it can be determined that an abnormality has occurred in the aforementioned calculation functions.

(3) When an abnormality in the calculation functions of the microcomputer 21 occurs, a measure can be taken to keep the engine in operation to the maximum possible extent by executing the failsafe process.

(4) Besides, when it is difficult to keep the engine in operation even through the failsafe process, the continuation of unstable operation of the engine can be avoided by forcibly stopping the engine (stalling the engine).

Incidentally, the aforementioned embodiment of the invention can also be modified, for example, as follows. The smaller one of the start-up injection amount Qst calculated this time and the monitoring start-up injection amount Qstm calculated last time may be used as the current monitoring start-up injection amount Qstm. In this case, when the start-up injection amount Qst is used as the injection amount command value Qfin after the completion of start-up of the engine, the smaller one of the start-up injection amount Qst calculated this time and the monitoring start-up injection amount Qstm calculated last time is used as the current monitoring start-up injection amount Qstm, and furthermore, the monitoring start-up injection amount Qstm is used as the monitoring injection amount Qfinm. Even when this configuration is adopted, it is possible to determine whether or not the aforementioned abnormality E1 has occurred as an abnormality in the calculation functions of the microcomputer 21 regarding calculation of the injection amount command value Qfin and the like.

The aforementioned forcible stop of the engine is not absolutely required to be performed. The aforementioned failsafe process is not absolutely required to be executed either. Although a value larger than "0" is preferably adopted as the determination threshold H, "0" can also be adopted as the determination threshold H.

The predetermined value A may be a value that is larger than the determination threshold H, or a value that is equal to the determination threshold H.

What is claimed is:

1. A monitoring device for a fuel injection amount control apparatus, the fuel injection amount control apparatus being configured to drive an injector provided in an engine based on an injection amount command value, the monitoring device comprising:

a calculation unit configured to: in calculating the injection amount command value at intervals of a specified time, (i) calculate a start-up injection amount based on a cooling fluid temperature of the engine such that the start-up injection amount becomes smaller when the cooling fluid temperature is high than when the cooling fluid temperature is low, (ii) use the start-up injection amount as the injection amount command value from start of start-up of the engine to completion of start-up of the engine, and (iii) use the larger one of the start-up injection amount and a basic injection amount that is calculated based on an operation state of the engine, as the injection amount command value, after completion of start-up of the engine; and a determination unit configured to: in calculating a monitoring injection amount at intervals of a specified time, (i) use the larger one of a monitoring start-up injection amount calculated based on the start-up injection amount and a monitoring basic injection amount calculated based on the operation state of the engine, as the monitoring injection amount, (ii) use a start-up injection amount calculated this time by the calculation unit, as the monitoring start-up injection amount, from start of start-up of the engine to completion of start-up of the engine, (iii) use the smaller one of the start-up injection amount calculated this time by the calculation unit and a last monitoring start-up injection amount calculated by the determination unit, as a current monitoring start-up injection amount, after completion of start-up of the engine, and (iv) determine that the calculation unit is abnormal when an injection amount command value calculated this time by the calculation unit deviates, in an increasing manner, from a monitoring injection amount calculated this time.

2. The monitoring device for the fuel injection amount control apparatus according to claim 1, further comprising:

a storage unit configured to store a change pattern of a maximum value that can be assumed by the start-up injection amount with lapse of time after completion of start-up of the engine, wherein the determination unit is configured to, after completion of start-up of the engine, use the smallest one of the start-up injection amount calculated this time by the calculation unit, the last monitoring start-up injection amount calculated by the determination unit, and the maximum value obtained based on an elapsed time from completion of start-up of the engine using the change pattern that is stored in the storage unit, as the current monitoring start-up injection amount.

* * * * *